US008948666B2

(12) United States Patent
Imai et al.

(10) Patent No.: US 8,948,666 B2
(45) Date of Patent: Feb. 3, 2015

(54) DEVELOPING DEVICE HAVING THICKNESS REGULATION BLADE

(71) Applicants: Masashi Imai, Kasugai (JP); Marika Ogiso, Nagoya (JP)

(72) Inventors: Masashi Imai, Kasugai (JP); Marika Ogiso, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 51 days.

(21) Appl. No.: 13/746,858

(22) Filed: Jan. 22, 2013

(65) Prior Publication Data

US 2013/0188998 A1 Jul. 25, 2013

(30) Foreign Application Priority Data

Jan. 23, 2012 (JP) ..... 2012-011503

(51) Int. Cl.
*G03G 15/08* (2006.01)

(52) U.S. Cl.
CPC ..... *G03G 15/0812* (2013.01)
USPC ..... 399/284

(58) Field of Classification Search
CPC ..... G03G 15/0812
USPC ..... 399/274, 284
See application file for complete search history.

(56) References Cited

U.S. PATENT DOCUMENTS 6,226,485 B1 5/2001 Purizhansky
6,341,206 B1 * 1/2002 Yamaguchi et al. ..... 399/103
8,014,707 B2 9/2011 Nishiyama et al.
8,129,014 B2 * 3/2012 Nakamura et al. ..... 428/212
2002/0191990 A1 12/2002 Hirano et al.
2009/0169272 A1 7/2009 Nishiyama et al.
2010/0158581 A1 6/2010 Mori
2013/0188997 A1 7/2013 Imai et al.

FOREIGN PATENT DOCUMENTS

JP 11-231647 A 8/1999
JP 2005-242158 A 9/2005
JP 2009-175678 A 8/2009

OTHER PUBLICATIONS

Non-final Office Action received in corresponding U.S. Appl. No. 13/746,804 dated Feb. 27, 2014.

* cited by examiner

*Primary Examiner* — David Gray
*Assistant Examiner* — Gregory H Curran
(74) *Attorney, Agent, or Firm* — Banner & Witcoff, Ltd.

(57) ABSTRACT

A developing device includes: a casing; a developing roller rotatably supported to the casing; a resiliently deformable blade supported to the casing; a regulation portion; and a covering portion. The developing roller is rotatable in a rotational direction and carries a layer of developer thereon. The blade extends in an axial direction of the developing roller and has one axial end portion formed with a through-hole, the blade having a first surface facing the developing roller and a second surface opposite to the first surface. The regulation portion is configured to be in contact with the developing roller to regulate a thickness of the layer of the developer carried on the developing roller. The covering portion is provided on the second surface and positioned to cover the through-hole.

7 Claims, 5 Drawing Sheets

DEVELOPING DEVICE HAVING THICKNESS REGULATION BLADE

CROSS REFERENCE TO RELATED APPLICATION

This application claims priority from Japanese Patent Application No. 2012-011503 filed Jan. 23, 2012. The entire content of the priority application is incorporated herein by reference.

TECHNICAL FIELD

The present invention relates to a developing device provided with a thickness regulation blade for regulating a thickness of developer.

BACKGROUND

An electrophotographic image forming apparatus uses a developing device having a casing and a developing roller rotatably supported thereto. On a surface of the developing roller, a thin layer of toner having a uniform thickness needs to be formed. To this effect, the developing device is provided with a thickness regulation blade configured to be in contact with the surface of the developing roller for flattening toner provided thereon.

There are two types of thickness regulation blades: "against-type" and "with-type." Assuming that a thickness regulation blade has a base end fixed to the casing of the developing device and a distal end in contact with the surface of the developing roller, the thickness regulation blade is called as "against-type" when a direction from the base end toward the distal end is opposite to a rotation direction of the developing roller; and the thickness regulation blade is called as "with-type" when the direction from the base end toward the distal end is coincident with the rotation direction of the developing roller. There is also known a conventional thickness regulation blade having a portion provided with a regulating portion made of a rubber material, the portion being in contact with the surface of the developing roller.

SUMMARY

Incidentally, in the "against-type" thickness regulation blade, contact pressure against the developing roller can be ensured relatively easy, since the distal end of the thickness regulation blade is brought into pressure contact with the surface of the developing roller by friction between the distal end and the developing roller. On the other hand, in the "with-type" thickness regulation blade, contact pressure against the developing roller is harder to be obtained, compared to the "against-type".

In order to form the regulating portion in the "with-type" thickness regulation blade, a through-hole may be formed in a longitudinal end portion of the blade so that a material for forming the regulating portion can be injected through the through-hole to be provided on the blade. However, forming the through-hole in the blade may reduce rigidity of the blade (resiliency of the blade) partially in the vicinity of the through-hole, preventing the toner layer from being formed uniformly on the surface of the developing roller.

It is an object of the present invention is to provide a developing device having a with-type thickness regulation blade that enables a toner layer to be formed uniformly on a surface of a developing roller.

In order to achieve this and other objects of the present invention, there is provided a developing device including: a casing; a developing roller rotatably supported to the casing; a resiliently deformable blade supported to the casing; a regulation portion; and a covering portion. The developing roller defines an axis extending in an axial direction and is configured to rotate in a rotational direction and to carry a layer of developer thereon. The blade extends in the axial direction, the blade having a first surface facing the developing roller and a second surface opposite to the first surface, the blade having one axial end portion formed with a through-hole. The regulation portion is configured to be in contact with the developing roller to regulate a thickness of the layer of the developer carried on the developing roller. The covering portion is provided on the second surface and positioned to cover the through-hole.

BRIEF DESCRIPTION OF THE DRAWINGS

The particular features and advantages of the invention as well as other objects will become apparent from the following description taken in connection with the accompanying drawings, in which.

DETAILED DESCRIPTION

An electro-photographic type color LED printer 1 as an example of an image forming apparatus incorporating a developing device according to an embodiment of the present invention will be described with reference to FIGS. 1 to 7.

Figure 1:
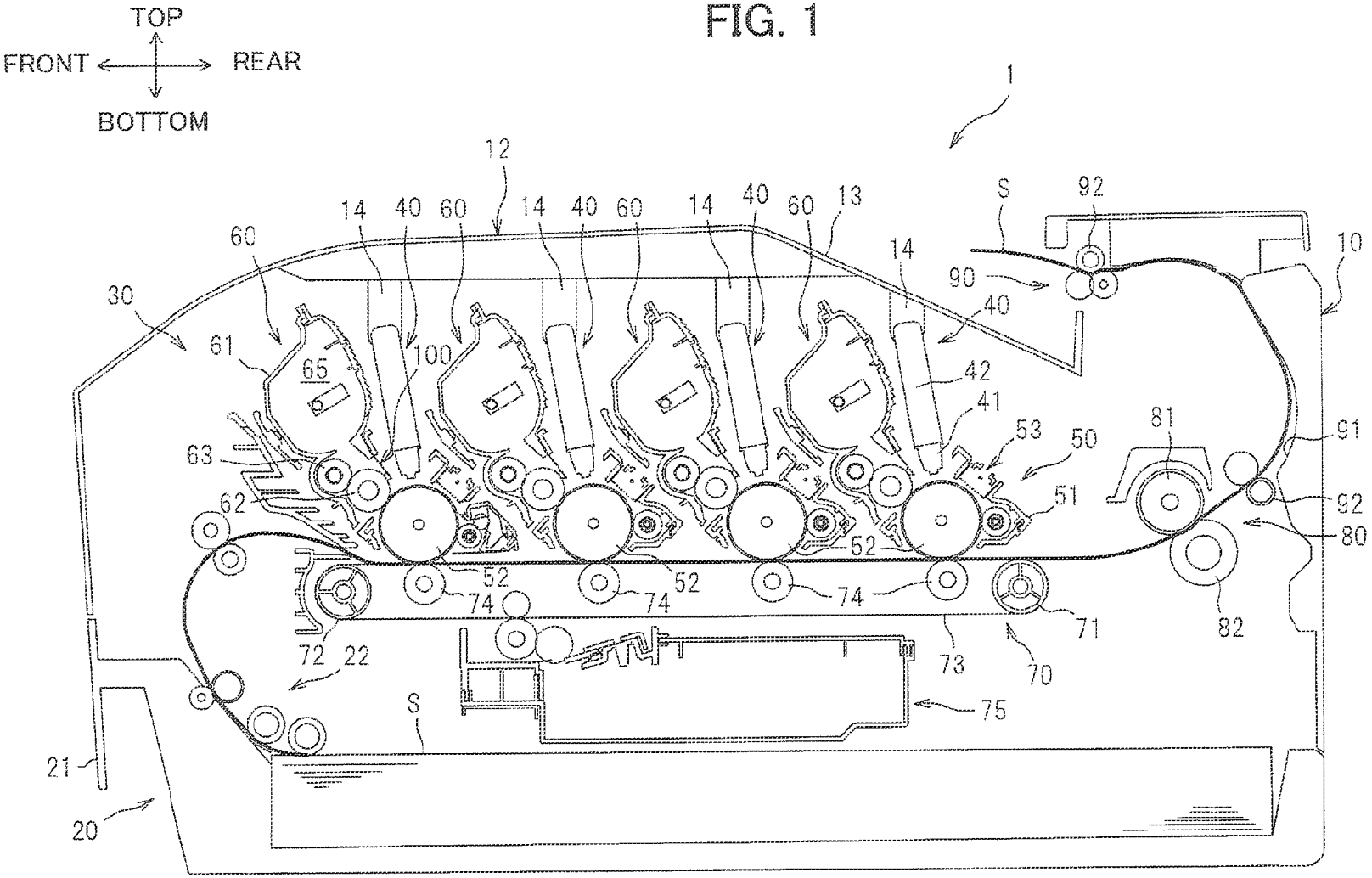
FIG. 1 is a cross-sectional view showing a general configuration of a color LED printer as an image forming apparatus incorporating a developing device according to an embodiment of the present invention.

Throughout the specification, the terms "upward", "downward", "upper", "lower", "above", "below", "beneath", "right", "left", "front", "rear" and the like will be used assuming that the color LED printer 1 is disposed in an orientation in which it is intended to be used. In use, the color LED printer 1 is disposed as shown in FIG. 1. Specifically, in FIG. 1, a left side, a right side, a near side and a far side of the color LED printer 1 are referred to as a front side, a rear side, a right side and a left side, respectively. Further, the top and bottom of the color LED printer 1 will be based on a vertical direction in FIG. 1.

<Overall Structure of Color LED Printer>

As illustrated in FIG. 1, a color LED printer 1 includes a main casing 10, within which disposed are a sheet supply section 20 configured to supply sheets S, an image forming section 30 configured to form images onto the supplied sheets S, and a sheet discharge section 90 configured to discharge the image-formed sheets S.

An upper cover 12 is provided at an upper end portion of the main casing 10. The upper cover 12 is pivotally movable about a rear side thereof so as to open and close in a vertical direction. The upper cover 12 has an upper surface serving as a sheet discharge tray 13 onto which the sheets S discharged from the main casing 10 is placed. The upper cover 12 has a lower surface on which four holding portions 14 are provided each for pivotally movably supporting an LED unit 40 to be described later.

The sheet supply section 20 is provided at a lower end portion of the main casing 10. The sheet supply section 20 includes a sheet supply tray 21 configured to accommodate a stack of the sheets S, and a sheet supply mechanism 22 configured to supply each sheet S from the sheet supply tray 21 to the image forming section 30. The sheets S accommodated in the sheet supply tray 21 are separated one by one by the sheet supply mechanism 22 and supplied to the image forming section 30.

The image forming section 30 includes four LED units 40, four photosensitive units 50, four developing devices 60, a transfer unit 70, and a fixing unit 80.

The LED units 40 are arranged in a front-rear direction below the upper cover 12. The LED units 40 are disposed to face respective photosensitive drums 52 from above thereof when the upper cover 12 is closed. Each LED unit 40 includes a head portion 41 and a support portion 42 that supports the head portion 41. The head portion 41 has a tip end portion on which a plurality of not-illustrated light-emitting portions (LEDs) is arranged in a left-right direction. The support portion 42 is attached to the upper cover 12 through the corresponding holding portion 14. In the LED unit 40 having the above configuration, the light-emitting portions are configured to blink based on image data so as to expose a surface of a corresponding charged photosensitive drum 52.

The photosensitive units 50 are juxtaposed in the front-rear direction between the upper cover 12 and sheet supply section 20. Each photosensitive unit 50 includes a drum casing 51, a photosensitive drum 52, and a charger 53.

The developing devices 60 are arrayed in the front-rear direction at substantially the same height as the LED units 40 in the vertical direction. The developing units 60 can be attached to/detached from the main casing 10 when the upper cover 12 is opened. Each developing unit 60 includes a casing 61, a developing roller 62, a supply roller 63, a thickness regulation blade 100, and a toner chamber 65 that accommodates toner as an example of developer (also see FIG. 2).

The transfer unit 70 is provided between the sheet supply section 20 and the photosensitive units 50 in the vertical direction. The transfer unit 70 includes a drive roller 71, a follow roller 72, an endless conveying belt 73, four transfer rollers 74, and a cleaning section 75. The endless conveying belt 73 is mounted on the drive roller 71 and the follow roller 72 in a taut state, and has an outer peripheral surface configured to be in contact with each of the photosensitive drums 52. The conveying belt 73 defines an internal space in which the four transfer rollers 74 are disposed such that the conveying belt 73 is nipped between each transfer roller 74 and corresponding photosensitive drum 52.

The fixing unit 80 is disposed rearward of the photosensitive units 50. The fixing unit 80 includes a heat roller 81, and a pressure roller 82 opposing the heat roller 81 so as to apply pressure to the same.

In the image forming section 30, the surface of each photosensitive drum 52 is uniformly charged by the charger 53 and then exposed by the corresponding LED unit 40, thereby an electrostatic latent image being formed on the surface of the photosensitive drum 52 based on image data. The toner in each toner chamber 65 is supplied to the developing roller 62 through the supply roller 63, and then enters between the developing roller 62 and the thickness regulation blade 100 so as to be carried on the developing roller 62 as a thin layer having a constant thickness.

The toner carried on each developing roller 62 is then supplied to the corresponding photosensitive drum 52 on which the electrostatic latent image has been formed to develop the electrostatic latent image into a visible toner image. Thereafter, the sheet S supplied from the sheet supply section 20 is conveyed between each photosensitive drum 52 and the conveying belt 73 (corresponding transfer roller 74), whereby the toner images formed on the respective photosensitive drums 52 are sequentially superimposed onto the sheet S to form a color toner image. The sheet S onto which the color toner image has been formed is then conveyed between the heat roller 81 and the pressure roller 82, whereby the color toner image is thermally fixed onto the sheet S.

The sheet discharge section 90 includes a sheet discharge path 91 and a plurality of conveying rollers 92 configured to convey the sheet S. The sheet discharge path 91 is formed so as to extend upward from an outlet of the fixing unit 80 and turn its direction frontward, and a plurality of conveying rollers 92 that convey the sheet S. The sheet S onto which the toner image has been thermally fixed is conveyed along the sheet discharge path 91 by the conveying rollers 92 and discharged onto the sheet discharge tray 13 outside the main casing 10.

<Detailed Configuration of Developing Device>

A detailed configuration of the thickness regulation blade 100 and portions adjacent thereto in each developing device 60 will be described. In the following description, directions with respect to the developing unit 60 are different from those defined in FIG. 1. That is, directions with respect to the developing unit 60 (top, bottom, left, right, front, rear) will be referred to as defined in FIG. 3.

Figure 2:
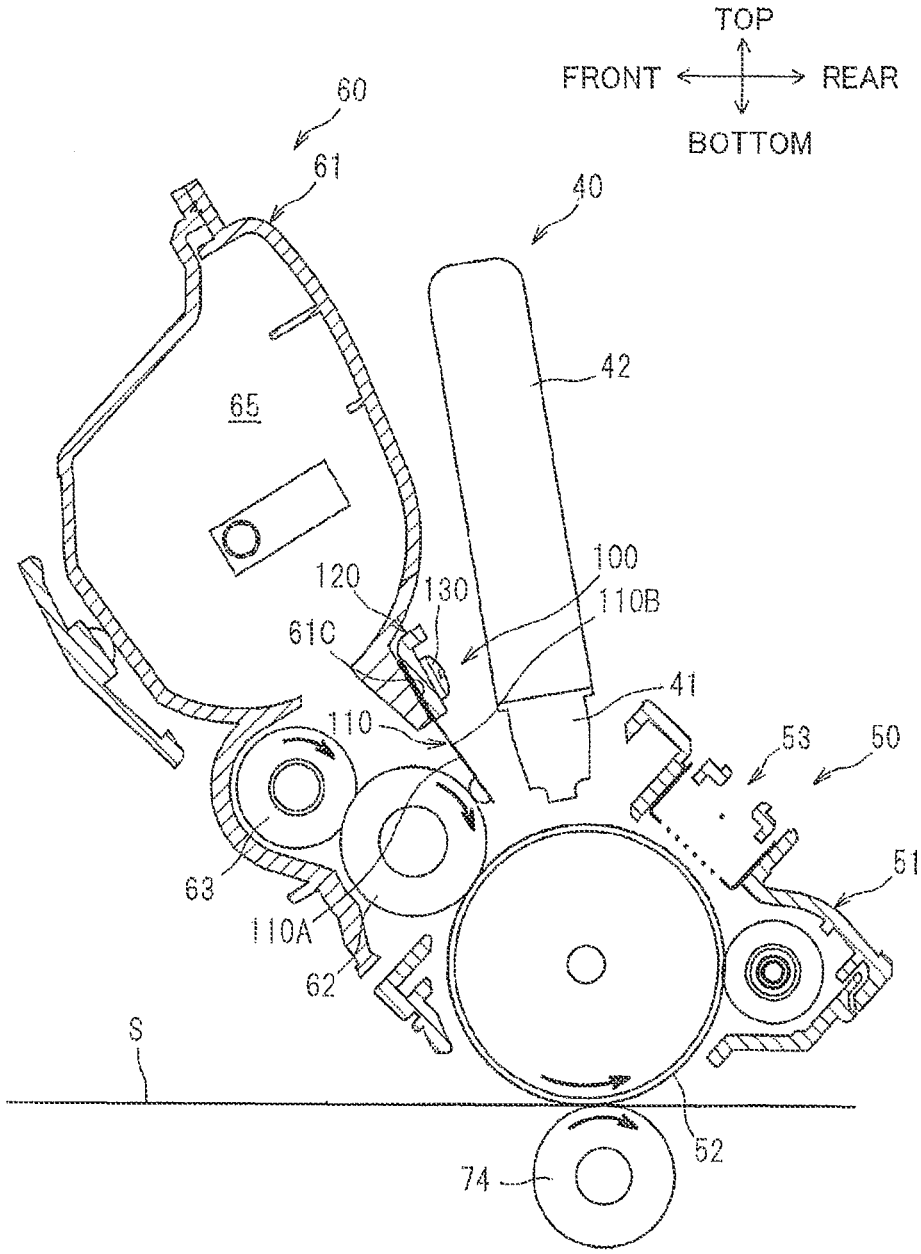
FIG. 2 is an enlarged cross-sectional view of the developing device of FIG. 1 and in the vicinity thereof.
Figure 3:
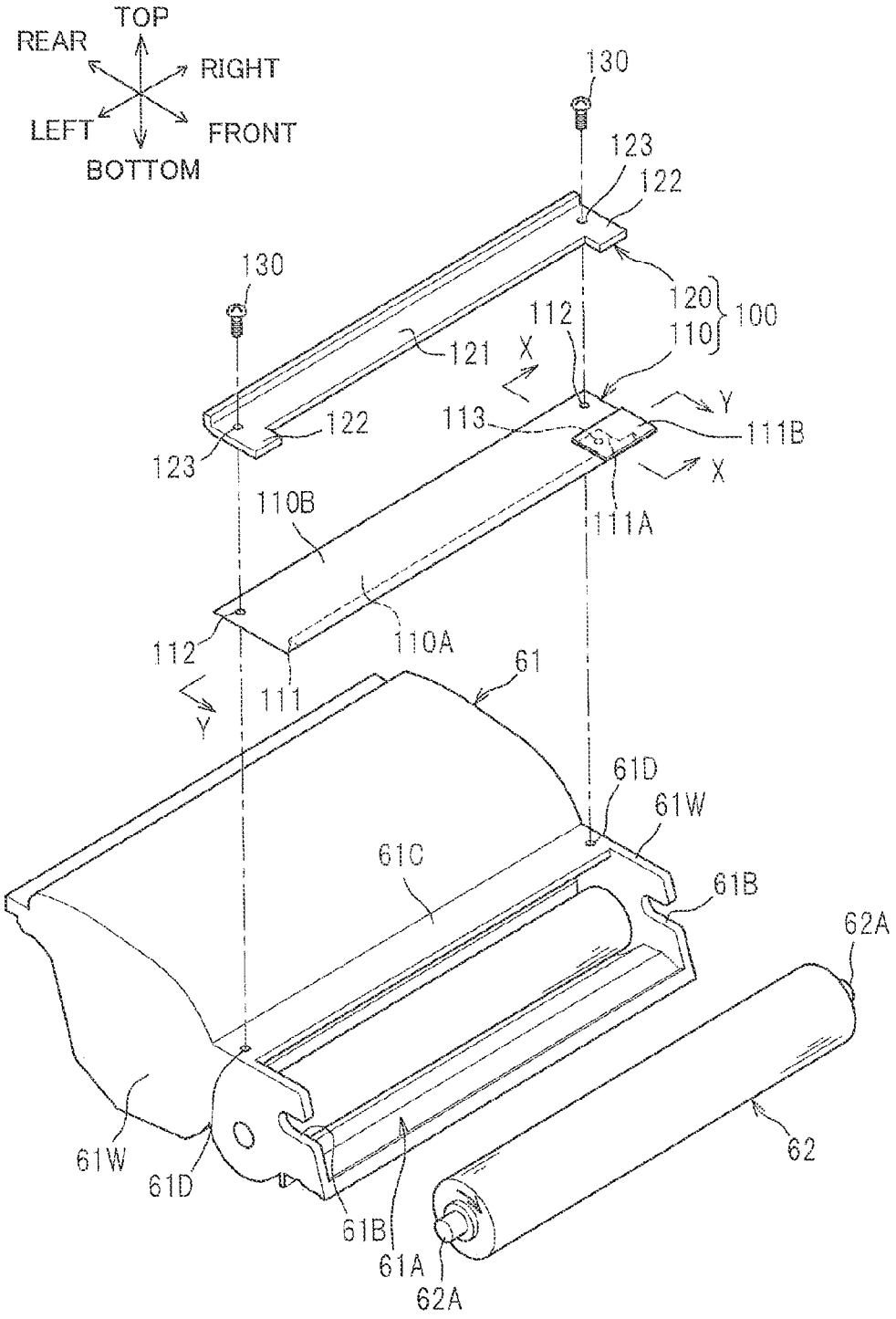
FIG. 3 is an exploded perspective view of the developing device according to the embodiment, the developing device including a thickness regulation blade.

As illustrated in FIG. 3, the casing 61 of the developing device 60 has a front end portion in which an opening 61A is formed. The developing roller 62 is mounted in the casing 61 so as to substantially close the opening 61A (also see FIG. 2). The casing 61 has left and right side walls 61W each having a front end portion in which a groove 61B is formed for supporting the developing roller 62. Further, the casing 61 has an upper wall constituting an upper edge of the opening 61A, and the upper wall has an upper surface 61C serving as a support surface 61C that supports the thickness regulation blade 100. The support surface 61C has left and right end portions in each of which a screw hole 61D is formed for fixing the thickness regulation blade 100 by screws 130.

The developing roller 62 is a roller elongated in the left-right direction and has an outer peripheral surface made of a rubber. The developing roller 62 includes a shaft extending in an axial direction (i.e., left-right direction of the color LED printer 1) and the shaft has both axial ends provided with bearings 62A respectively. The bearings 62A are engaged with the respective grooves 61B of the casing 61 and fixed to the casing 61 by screws (not shown). As a result, the developing roller 62 is rotatably supported by the casing 61. The developing roller 62 is configured to rotate in a clockwise direction in FIGS. 2 and 3.

The thickness regulation blade 100 includes a blade 110 and a reinforcing plate 120.

The blade 110 is formed of a thin metal plate elongated in the axial direction of the developing roller 62. The blade 110 is thus resiliently deformable. The blade 110 has a rear end portion (base end portion) fixed to the support surface 61C of the casing 61, as will be described later.

The blade 110 has an inner surface 110A (first surface) configured to face the developing roller 62, and an outer surface 110B (second surface) opposite to the inner surface 110A.

The inner surface 110A has a front end portion (distal end portion) on which a regulating portion 111 made of a rubber-like material is provided. In other words, the regulating portion 111 is provided at a downstream side of the inner surface 110A in the rotation direction of the developing roller 62. The regulating portion 111 has a substantially semi-circular shape in cross section (see FIG. 2) and extends in the axial direction of the developing roller 62. When the blade 110 is fixed to the casing 61, the regulating portion 111 is configured to contact the outer peripheral surface of the developing roller 62, while the blade 110 is slightly being resiliently deformed, as shown in FIG. 2. Due to the resilient deformation of the blade 110, the regulating portion 111 can contact the outer peripheral surface of the developing roller 62 at a predetermined pressure and spread out (or flatten) the toner retained between the regulating portion 111 and the outer peripheral surface of the developing roller 62, thereby regulating a thickness of the toner layer.

Further, the blade 110 has left and right end portions in each of which a mounting hole 112 is formed at a position corresponding to each of the screw holes 61D.

The reinforcing plate 120 is mounted on the outer surface 110B of the blade 110. The reinforcing plate 120 is formed of a metal plate having a larger thickness and a higher rigidity than the metal plate of the blade 110. As illustrated in FIG. 3, the reinforcing plate 120 includes a main body portion 121 and two reinforcing portions 122. The main body portion 121 extends in the axial direction of the developing roller 62. The main body portion 121 has left and right end portions in each of which a mounting hole 123 is formed at a position corresponding to each screw hole 61D and each mounting hole 112.

Each of the two reinforcing portions 122 extends frontward from each axial end portion of the main body portion 121. That is, each reinforcing portion 122 extends toward downstream in the rotation direction of the developing roller 62.

As illustrated in FIG. 2, the main body portion 121 is disposed on a rear end portion (base end portion) of the outer surface 110B of the blade 110, that is, at an upstream side of the outer surface 110B in the rotation direction of the developing roller 62, when assembled to the casing 61. Hence, the reinforcing plate 120 can bring the base end portion of the blade 110 in close contact with the support surface 61C and reinforce the blade 110 from outward (above) such that the distal end portion of the blade 110 can resiliently deform substantially uniformly in the axial direction of the developing roller 62.

Figure 7:
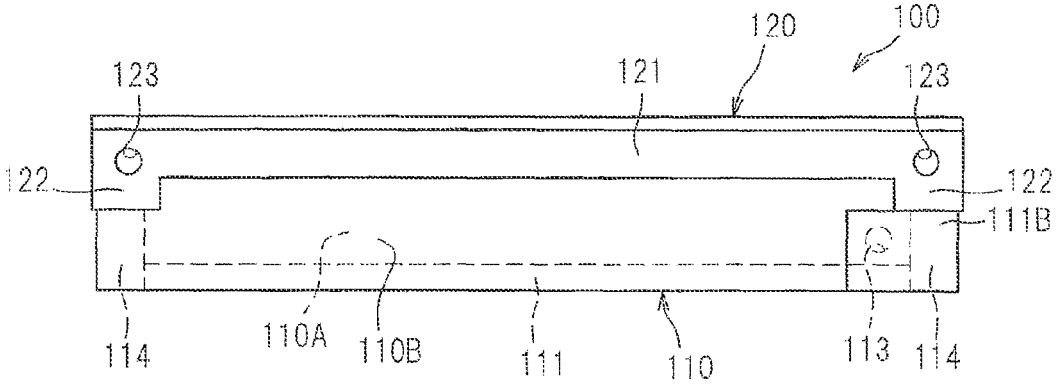
FIG. 7 is a top view of the thickness regulation blade according to the embodiment.

The blade 110 has one axial end portion (right end portion) in which a through-hole 113 is formed. More specifically, in the right end portion, the through-hole 113 is positioned closer to the regulating portion 111 than to the base end portion in the front-rear direction. The through-hole 113 is a hole through which the rubber-like material for forming the regulating portion 111 is adapted to penetrate in order to form of the regulating portion 111. Specifically, as illustrated in FIGS. 3 and 7, the through-hole 113 is positioned in a region that does not overlap with (aligned with) the right reinforcing portion 122 in the front-rear direction. With respect to the left-right direction (axial direction), the through-hole 113 is positioned slightly leftward of the right reinforcing portion 122 when the reinforcing plate 120 is attached to the blade 110.

Figure 4:
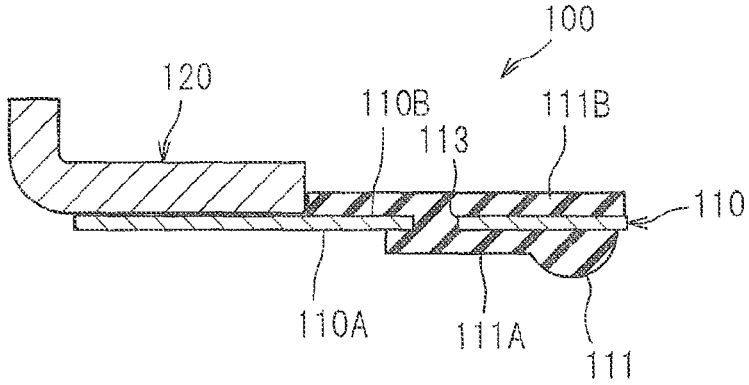
FIG. 4 is a cross-sectional view of the thickness regulation blade according to the embodiment taken along a line X-X shown in FIG. 3.

Further, as shown in FIG. 4, the regulating portion 111 extends up to the through-hole 113 while forming a flat-plate portion 111A along the inner surface 110A, and passes through the through-hole 113 to extend on the outer surface 110B to form a covering portion 111B thereon. In a metal die used to form the regulating portion 111 by injection molding, one of cavities serves to form a path connecting between the through-hole 113 and the regulating portion 111. The rubber-like material entering this path and remaining intact after completion of injection molding corresponds to the flat-plate portion 111A.

Figure 5:
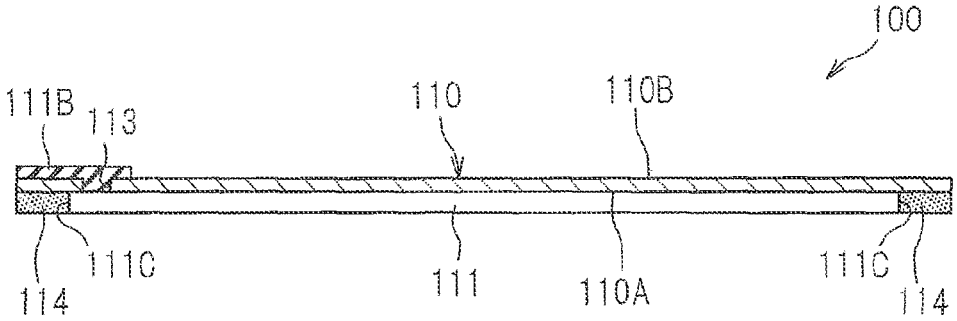
FIG. 5 is a cross-sectional view of the thickness regulation blade according to the embodiment taken along a line Y-Y shown in FIG. 3.

In other words, as illustrated in FIGS. 4 and 5, the covering portion 111B is integrally formed with the regulating portion 111 and the flat-plate portion 111A via the through-hole 113. The covering portion 111B extends, along the outer surface 110B, rightward to reach one end (right end) of the blade 110, and leftward to cover the through-hole 113.

Figure 6:
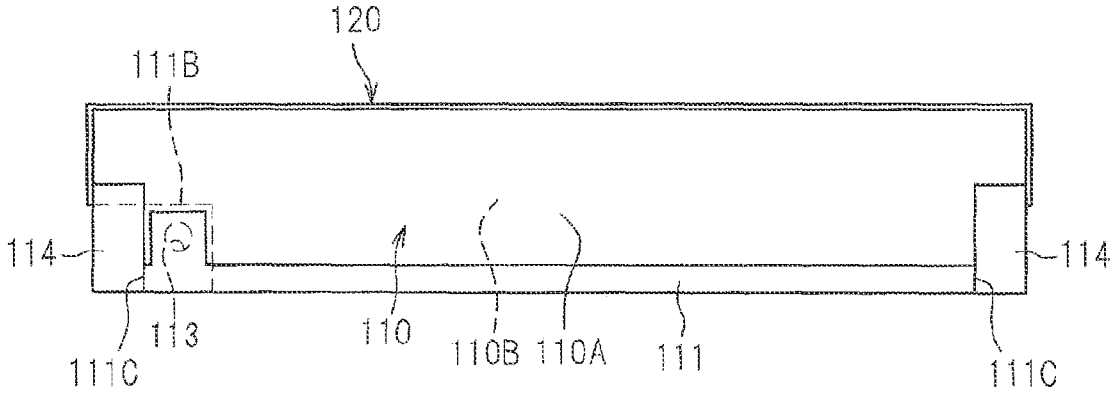
FIG. 6 is a back view of the thickness regulation blade according to the embodiment.

Further, as illustrated in FIGS. 5 and 6, left and right seal members 114 are disposed on the inner surface 110A such that each seal member 114 is in contact with each end face 111C of the regulating portion 111 in the axial direction. The seal members 114 are configured to be in abutment with the outer peripheral surface of the developing roller 62 at both axial end portions thereof so as to prevent toner leakage therefrom.

The covering portion 111B occupies a region on the outer surface 110B that overlaps with the right seal member 114 in the vertical direction (in a direction perpendicular to the inner surface 110A) as shown in FIGS. 5 and 6, and that overlaps with the right reinforcing portion 122 in the axial direction, as shown in FIG. 7.

The above-described blade 110 is assembled with the reinforcing plate 120 and is then fixed to the casing 61 by screwing the screws 130 into the respective screw holes 61D of the casing 61 via the mounting holes 123 and 112.

The developing device 60 according to the present embodiment is attached to the main casing 10 of the color LED printer 1 for use. When a print command is received at the color LED printer 1, the developing roller 62 and the supply roller 63 are rotated to supply the toner from the supply roller 63 to the developing roller 62. The toner entering between the thickness regulation blade 100 and the developing roller 62 is flattened by the regulating portion 111 so as to be carried on the outer peripheral surface of developing roller 62 as a thin layer.

Inherently, the blade 110 has a higher rigidity at its center portion relative to its both end portions in the axial direction. Here, suppose that the covering portion 111B is not provided on the outer surface 110B of the blade 110. In this case, since the through-hole 113 is formed only near the one axial end portion of the blade 110, rigidity of the axial end portion, which is originally low, may become further lower. As a result, pressing force of the regulating portion 111 near the through-hole 113 against the developing roller 62 would become weaker, thereby making the toner layer on the peripheral surface of the developing roller 62 thicker only in that portion corresponding to and adjacent to the through-hole 113.

However, in the developing device 60 according to the present embodiment, the covering portion 111B is provided to cover (overlap with) the through-hole 113 in the axial direction. Therefore, a reduction in rigidity attributed to formation of the through-hole 113 only on one axial end portion is not significant. The regulating portion 111 can thus contact the developing roller 62 at a generally uniform pressure in the axial direction, leading to formation of the toner layer having a generally uniform thickness on the developing roller 62.

Further, since the covering portion 111B extends up to the one axial end (right end) of the blade 110 in the embodiment, reduction in the rigidity of the blade 110 around the through hole 113 as well as at the one axial end can be suppressed.

Further, the reinforcing portions 122 are provided on the outer surface 110B of the blade 110. Therefore, reduction in the rigidity of the blade 110 at the one axial end portion can be further suppressed.

Further, the covering portion 111B is formed so as to overlap with the right seal member 114 provided on the inner surface 110A of the blade 110 in the direction perpendicular to the inner surface 110A. Hence, sufficient contact pressure between the seal member 114 and the developing roller 62 can be ensured, which leads to enhancement of sealing performance therebetween.

Further, the regulating portion 111 and the covering portion 11B are integrally formed of the rubber-like material. This means that the regulating portion 111 and the covering portion 11B can be formed simultaneously, and also, the regulating portions 111 can be prevented from coming off from the blade 110.

Various modifications are conceivable.

The covering portion 111B may have other configurations, provided that the covering portion 111B covers (overlaps with) the through-hole 113 in the direction perpendicular to the inner surface 110A.

Figure 8:
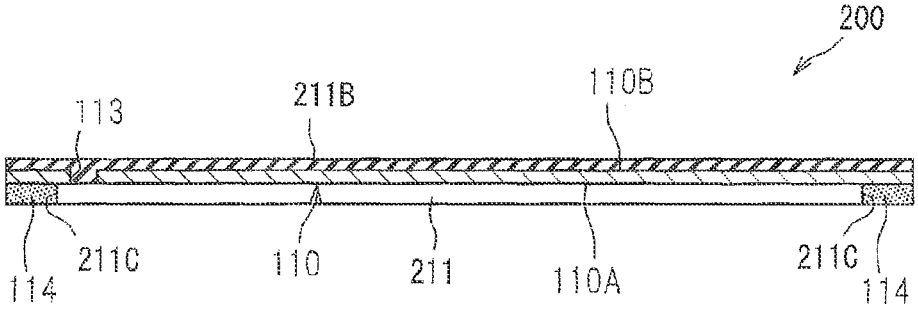
FIG. 8 is a cross-sectional view of a thickness regulation blade according to a first modification of the present invention taken along a line corresponding to the line Y-Y of FIG. 3.

FIG. 8 shows a thickness regulation blade 200 according to a first modification of the present embodiment. Like parts and components are designated by the same reference numerals as those of the embodiment in order to avoid duplicating description.

In the thickness regulation blade 200, a regulating portion 211 includes a covering portion 211B that extends not only to the one axial end (right end) of the blade 110, but also to another axial end (left end) of the blade 110. In this case as well, a reduction in the rigidity of the blade 110 around the through-hole 113 can be suppressed. At the same time, incidentally, the covering portion 211B is disposed to overlap with both seal members 114 in the direction perpendicular to the inner surface 110A (in the vertical direction). This allows the seal members 114 contacting the left and right end faces 111C of the regulating portion 211 to be reinforced by the covering portion 211B, thereby ensuring sufficient contact pressure between the left and right seal members 114 and the developing roller 62. Sealing performance of the seal members 114 relative to the developing roller 62 can be thus enhanced.

Further, the through-hole 113 may be positioned arbitrary, provided that the through-hole 113 is formed in either one axial end portion of the blade 110.

Figure 9:
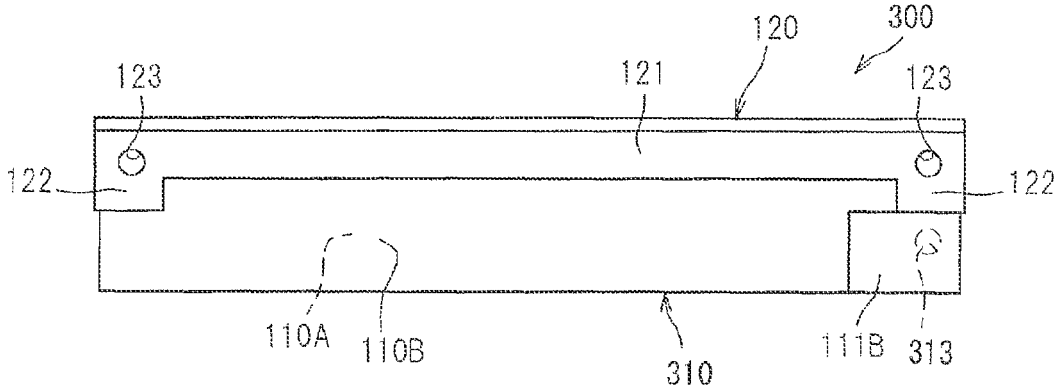
FIG. 9 is a top view of a thickness regulation blade according to a second modification of the present invention.

FIG. 9 shows a thickness regulation blade 300 according to a second modification of the present embodiment. Like parts and components are designated by the same reference numerals as those of the embodiment in order to avoid duplicating description.

In the depicted embodiment, the through-hole 113 is formed slightly leftward relative to the right reinforcing portion 122 in the axial direction. However, in the thickness regulation blade 300 of the second modification, a through-hole 313 is formed, on a blade 310, in a region that overlaps with (aligned with) the right reinforcing portion 122 in the axial direction. Also in this case, the covering portion 111B and the right reinforcing portion 122 function to mitigate a reduction in rigidity of the blade 310 around the through-hole 313 as well as at the right end of the blade 310.

Further, although the regulating portion 111 and covering portion 111B of the depicted embodiment are formed of a rubber-like material, the regulating portion 111 and covering portion 111B may be formed of a material other than a rubber-like material.

Further, instead of integrally forming the regulating portion 111 and the covering portion 111B, the regulating portion 111 and covering portion 111B may be formed as separate members, provided that the covering portion 111B is positioned to overlap with (cover) the through-hole 113 in the direction perpendicular to the inner surface 110A.

Further, the reinforcing plate 120 may dispense with the reinforcing portions 122. That is, the reinforcing plate 120 may be configured solely of the main body portion 121.

While the invention has been described in detail with reference to the embodiments thereof, it would be apparent to those skilled in the art that various changes and modifications may be made therein without departing from the spirit and scope of the invention.

What is claimed is:

1. A developing device comprising:

a casing;

a developing roller rotatably supported to the casing and defining an axis extending in an axial direction, the developing roller being configured to rotate in a rotational direction and to carry a layer of developer thereon;

a resiliently deformable blade supported to the casing and extending in the axial direction, the blade having a first surface facing the developing roller and a second surface opposite to the first surface, the blade having one axial end portion formed with a through-hole;

a regulation portion configured to be in contact with the developing roller to regulate a thickness of the layer of the developer carried on the developing roller; and a covering portion provided on the second surface and positioned to cover the through-hole, wherein the covering portion extends to a distal end of the one axial end portion.

2. The developing device as claimed in claim 1, wherein the regulation portion is provided on the first surface of the blade at a downstream side thereof in the rotational direction.

3. The developing device as claimed in claim 1, wherein the through-hole allows a material of the regulation portion to pass therethrough in order to form the regulation portion; and wherein the regulation portion and the covering portion are integrally formed via the through-hole.

4. The developing device as claimed in claim 3, wherein the regulation portion and the covering portion are integrally formed of a rubber-like material.

5. The developing device as claimed in claim 1, wherein the second surface has one distal end and another distal end in the axial direction; and wherein the covering portion extends from the one distal end to the another distal end.

6. The developing device as claimed in claim 1, wherein the regulation portion has an end face in the axial direction; and the developing device further comprising a seal member provided on the first surface and in contact with the end face; and wherein the covering portion is disposed to be aligned with the seal member in a direction perpendicular to the first surface.

7. The developing device as claimed in claim 1, further comprising a reinforcing plate provided on the second surface for reinforcement of the blade, the reinforcing plate including:

a main body portion extending in the axial direction and disposed at an upstream side of the second surface in the rotational direction, the main body portion having axial end portions in the axial direction; and a reinforcing portion extending from each axial end portion toward a downstream side of the second surface in the rotational direction, wherein the covering portion is provided in a region aligned with the reinforcing portion in the axial direction.

* * * * *